US008881830B2

(12) United States Patent
Papon et al.

(10) Patent No.: US 8,881,830 B2
(45) Date of Patent: Nov. 11, 2014

(54) RISER PIPE SECTION WITH FLANGED AUXILIARY LINES AND BAYONET CONNECTIONS

(75) Inventors: Gérard Papon, Les Essarts le Froi (FR); Emmanuel Persent, Croissy sur Seine (FR)

(73) Assignee: IFP Energies Nouvelles, Cedex (FR)

( * ) Notice: Subject to any disclaimer, the term of this patent is extended or adjusted under 35 U.S.C. 154(b) by 593 days.

(21) Appl. No.: 12/747,200

(22) PCT Filed: Dec. 1, 2008

(86) PCT No.: PCT/FR2008/001674

§ 371 (c)(1),
(2), (4) Date: Sep. 7, 2010

(87) PCT Pub. No.: WO2009/101279

PCT Pub. Date: Aug. 20, 2009

(65) Prior Publication Data

US 2010/0319925 A1 Dec. 23, 2010

(30) Foreign Application Priority Data

Dec. 18, 2007 (FR) ..... 07 08896

(51) Int. Cl.
*F16L 17/02* (2006.01)
*F16L 39/00* (2006.01)
*E21B 17/08* (2006.01)

(52) U.S. Cl.
CPC ..... *E21B 17/085* (2013.01)
USPC ..... 166/367; 166/345; 166/350; 166/351; 166/352; 166/355; 285/26; 285/29; 285/91; 285/402; 285/124.2

(58) Field of Classification Search
CPC ..... E21B 17/085
USPC ..... 285/26, 29, 81, 91, 92, 351, 402, 913, 285/914; 403/348–349; 166/350–352, 355, 166/367
See application file for complete search history.

(56) References Cited

U.S. PATENT DOCUMENTS 4,097,069 A * 6/1978 Morrill ..... 285/84
4,280,719 A * 7/1981 Daniel et al. ..... 285/90
4,330,140 A * 5/1982 Hampton ..... 285/39
4,550,936 A * 11/1985 Haeber et al. ..... 285/26

(Continued)

FOREIGN PATENT DOCUMENTS

FR 2 327 482 5/1977
FR 2 557 194 6/1985

(Continued)

*Primary Examiner* — James G Sayre
(74) *Attorney, Agent, or Firm* — Antonelli, Terry, Stout & Kraus, LLP.

(57) ABSTRACT

A riser pipe section (4) is disclose for offshore well drilling operations comprising a main tube element (6) having as an extension a male connector element (10) and a female connector element (9) comprising a first series of tenons. At least one auxiliary tube element (7) is secured to the male connector element (10) and to the female connector element (9) so that the main tube element (6) and the auxiliary tube element (7) jointly transmit tensile stresses between the male connector element (10) and the female connector element (9). A locking ring is mounted on the male connector element and the ring comprises a second series of tenons.

18 Claims, 5 Drawing Sheets

(56) References Cited

U.S. PATENT DOCUMENTS

| | | | | |
|---|---|---|---|---|
| 4,652,021 | A | 3/1987 | Pido | |
| 4,903,992 | A * | 2/1990 | Jennings et al. | 285/24 |
| 5,634,671 | A * | 6/1997 | Watkins | 285/18 |
| 6,623,044 | B1 | 9/2003 | Guesnon et al. | |
| 6,932,355 | B1 | 8/2005 | Hjertholm | |
| 7,341,281 | B2 * | 3/2008 | Guesnon et al. | 285/81 |
| 2005/0206163 | A1 | 9/2005 | Guesnon et al. | |

FOREIGN PATENT DOCUMENTS

| | | |
|---|---|---|
| FR | 2 799 789 | 4/2001 |
| FR | 2 866 942 | 9/2005 |
| FR | 2 891 577 | 4/2007 |
| FR | 2 891 578 | 4/2007 |
| FR | 2 891 579 | 4/2007 |
| GB | 1 553 096 | 9/1979 |
| GB | 1 553 097 | 9/1979 |

* cited by examiner

RISER PIPE SECTION WITH FLANGED AUXILIARY LINES AND BAYONET CONNECTIONS

BACKGROUND OF THE INVENTION

Field of the Invention

The present invention relates to the sphere of very deep sea drilling and oil field development. It concerns a riser pipe section.

A riser pipe is made up of an assembly of tubular elements assembled by connectors. The tubular elements generally consist of a main tube provided with a connector at each end thereof. The main tube is fitted with auxiliary lines commonly referred to as "kill line", "choke line", "booster line" and "hydraulic line", which allow circulation of a technical fluid. The tubular elements are assembled on the drilling site, from a floater. The riser pipe is lowered into the water depth as the tubular elements are assembled, until the wellhead located on the sea bottom is reached.

In the perspective of drilling at water depths that can reach 3500 m or more, the weight of the riser pipe becomes very penalizing. This phenomenon is increased by the fact that, for the same maximum working pressure, the length of the riser requires a larger inside diameter for the auxiliary lines considering the necessity to limit pressure drops.

Besides, the necessity to decrease the riser pipe assembly time is all the more critical since the water depth, and therefore the riser length, are great.

French Patents 2,891,577, 2,891,578 and 2,891,579 describe various solutions notably, aiming to involve the auxiliary lines, together with the main tube, in the taking up of the longitudinal stresses undergone by the riser pipe.

The present invention describes an alternative solution providing a compact connector design well suited for deep-sea risers, located at depths greater than 2000 meters.

SUMMARY OF THE INVENTION

In general terms, the invention relates to a riser pipe section for offshore well drilling operations, comprising a main tube element having as an extension a male connector element and a female connector element comprising a first series of tenons, wherein at least one auxiliary tube element is secured to the male connector element and to the female connector element so that the main tube and the auxiliary tube element jointly transmit tensile stresses between the male connector element and the female connector element, and wherein a locking ring is mounted on the male connector element with the ring comprising a second series of tenons.

According to the invention, the first series of tenons can be located on the inner surface of the female tubular element and the second series of tenons can be located on the outer surface of the ring.

The ring can be housed in a slot provided on the outer surface of the male tubular element.

The male connector element can comprise a first tubular part forming an extension of the main tube element and a second annular part mounted on the first part with the ring being mounted on the first part and locked in translation between the first and the second part.

Alternatively, the male connector element can comprise a first part forming an extension of the main tube element and a second tubular part mounted on the first part with the ring being mounted on the second part and locked in translation between the first and the second part.

The male connector element can be provided with a first shoulder extending towards the outside and the female connector element can be provided with a second shoulder extending towards the outside and said auxiliary tube element can be mounted axially abutted against the first shoulder and against the second shoulder.

The male connector element can form an extension of the main tube element while progressively increasing the section and the thickness of the main tube element up to the first shoulder and the female connector element can form an extension of the main tube element while progressively increasing the section and the thickness of the main tube element up to the second shoulder.

A wearing part can form an extension of one end of the auxiliary tube element.

The ring can comprise an operating means for moving the ring in rotation.

The riser pipe section can comprise a means for locking the ring.

The invention also relates to a riser pipe comprising at least two riser pipe sections according to the invention, wherein the longitudinal tensile stresses are distributed among the main tube element and the auxiliary tube element.

BRIEF DESCRIPTION OF THE DRAWINGS

Other features and advantages of the invention will be clear from reading the description hereafter, with reference to the accompanying figures wherein.

DETAILED DESCRIPTION OF THE INVENTION

Figure 1:
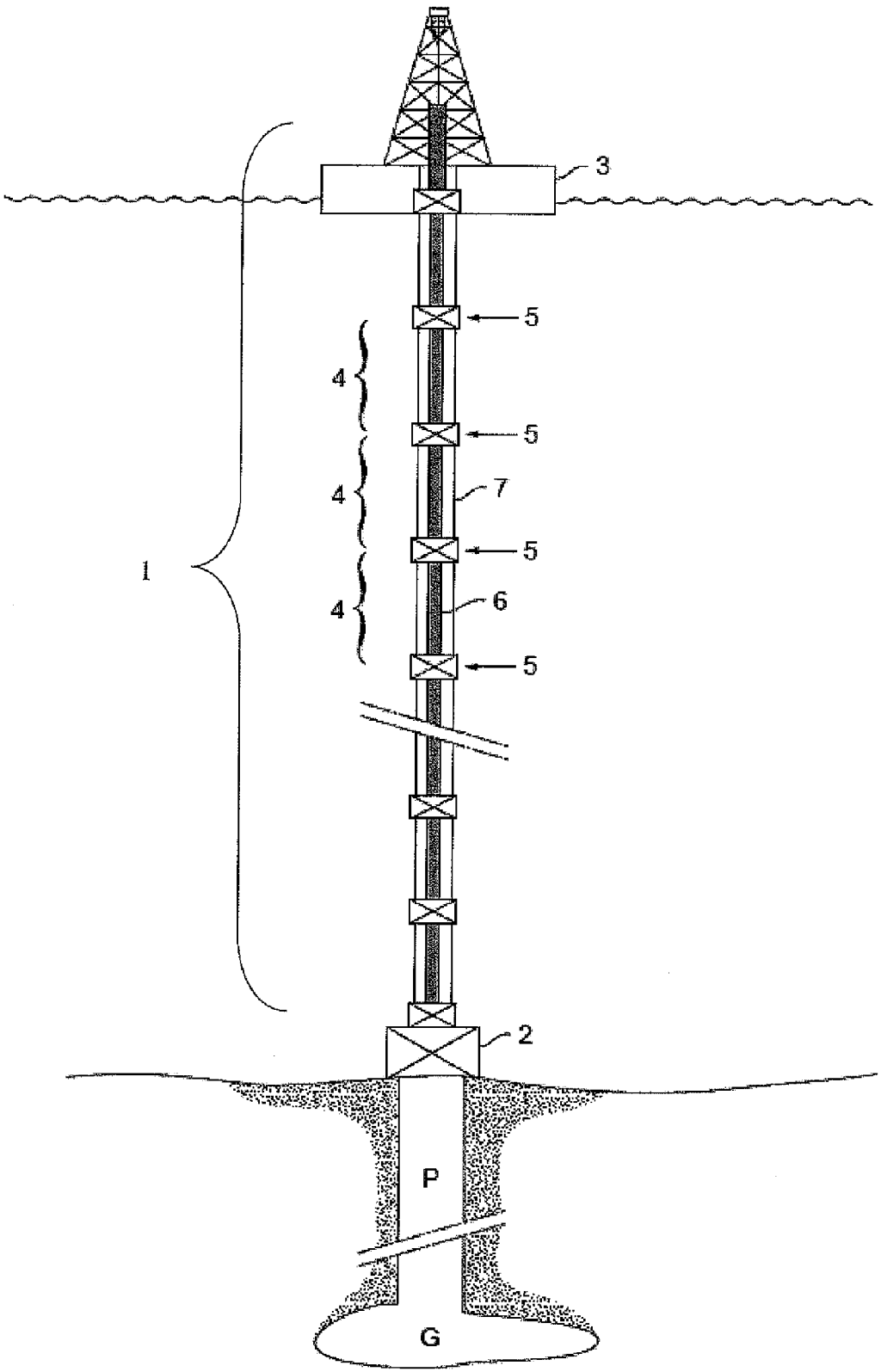
FIG. 1 diagrammatically shows a riser pipe.

FIG. 1 diagrammatically shows a riser pipe 1 installed offshore. Riser 1 forms an extension of well P and it extends from wellhead 2 to floater 3, a platform or a vessel for example. Wellhead 2 is provided with a preventer commonly referred to as "B.O.P." or "Blow-Out Preventer". The riser is made up of an assembly of several sections 4 assembled end to end by connectors 5. Each section has a main tube element 6 provided with at least one peripheral line element 7. The auxiliary lines, referred to as kill lines or choke lines, are used to provide well safety during control procedures relative to the inflow of fluids under pressure in the well. The line, referred to as booster line, allows mud to be injected into the well. The line, referred to as hydraulic line, allows the blow-out preventer of the wellhead to be controlled.

Figure 2:
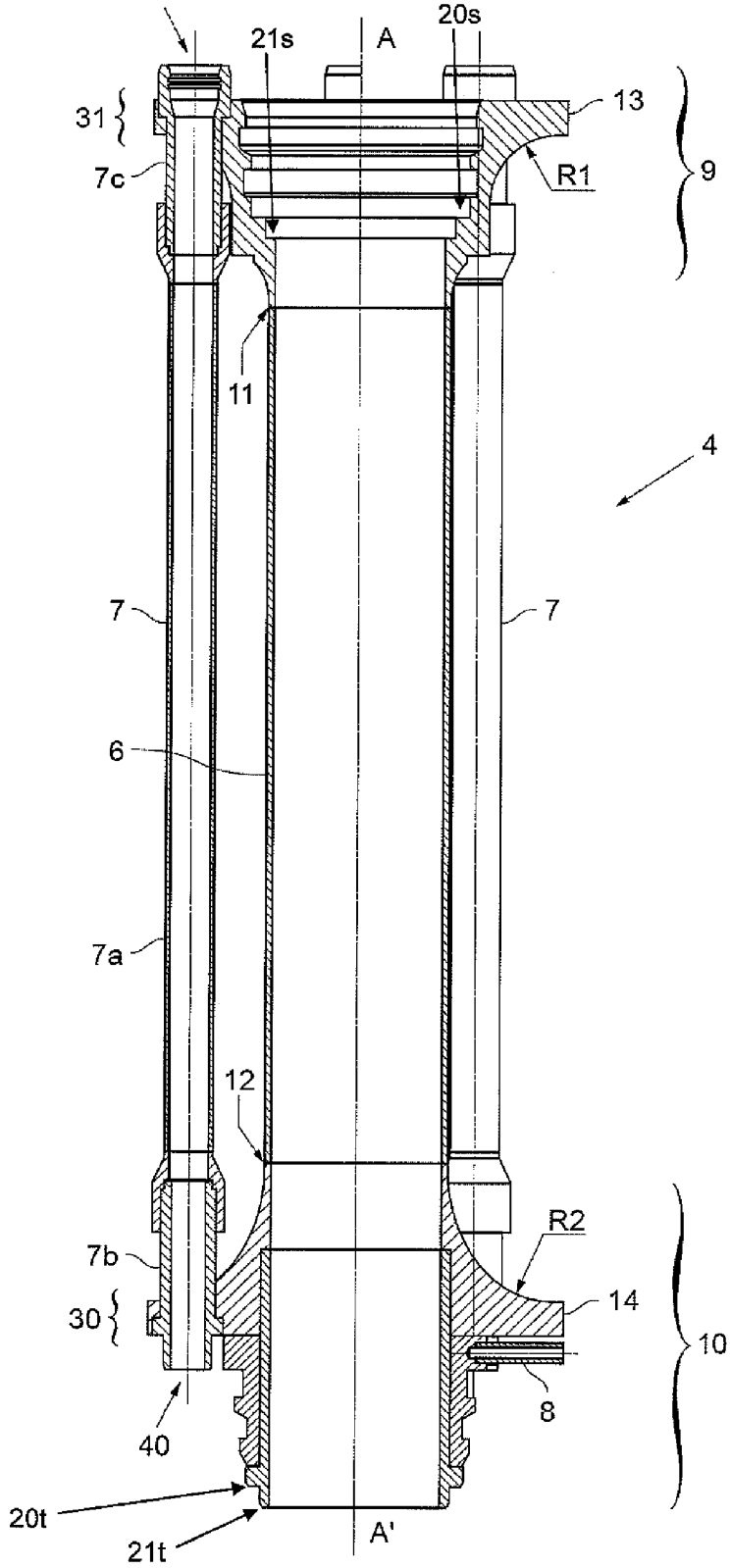
FIG. 2 shows a riser pipe section according to the invention.

FIG. 2 diagrammatically shows a section 4 of the riser pipe. Section 4 comprises a main tube element 6 whose axis AA' is the axis of the riser. Tubes 7 make up auxiliary lines or ducts arranged parallel to axis AA'. Elements 7 have lengths substantially equal to the length of main tube element 6, generally ranging between 10 and 30 meters. There is at least one line 7 arranged on the periphery of the main tube. In FIG. 2, two lines 7 are diagrammatically shown.

A connector 5 shown in FIG. 1 has two elements designated, with reference to FIG. 2, by female connector element 9 and male connector element 10. Elements 9 and 10 are mounted at the ends of main tube element 6. Female element 9 of the connector is secured to tube 6, for example by welding 11, by screwing, by crimping or by a clamping linkage. Male element 10 of the connector is secured to tube 6, for example by welding 12, by screwing, by crimping or by a clamping linkage. The assembly of male connector element 10 with female connector element 9 forms connector 5 that transmits stresses from one riser section to the next section which are notably the longitudinal stresses undergone by the riser.

Connector 5 can be designed and dimensioned so as to meet the specifications mentioned by the API 16 R and API 2 RD standards edited by the American Petroleum Institute.

Figure 3:
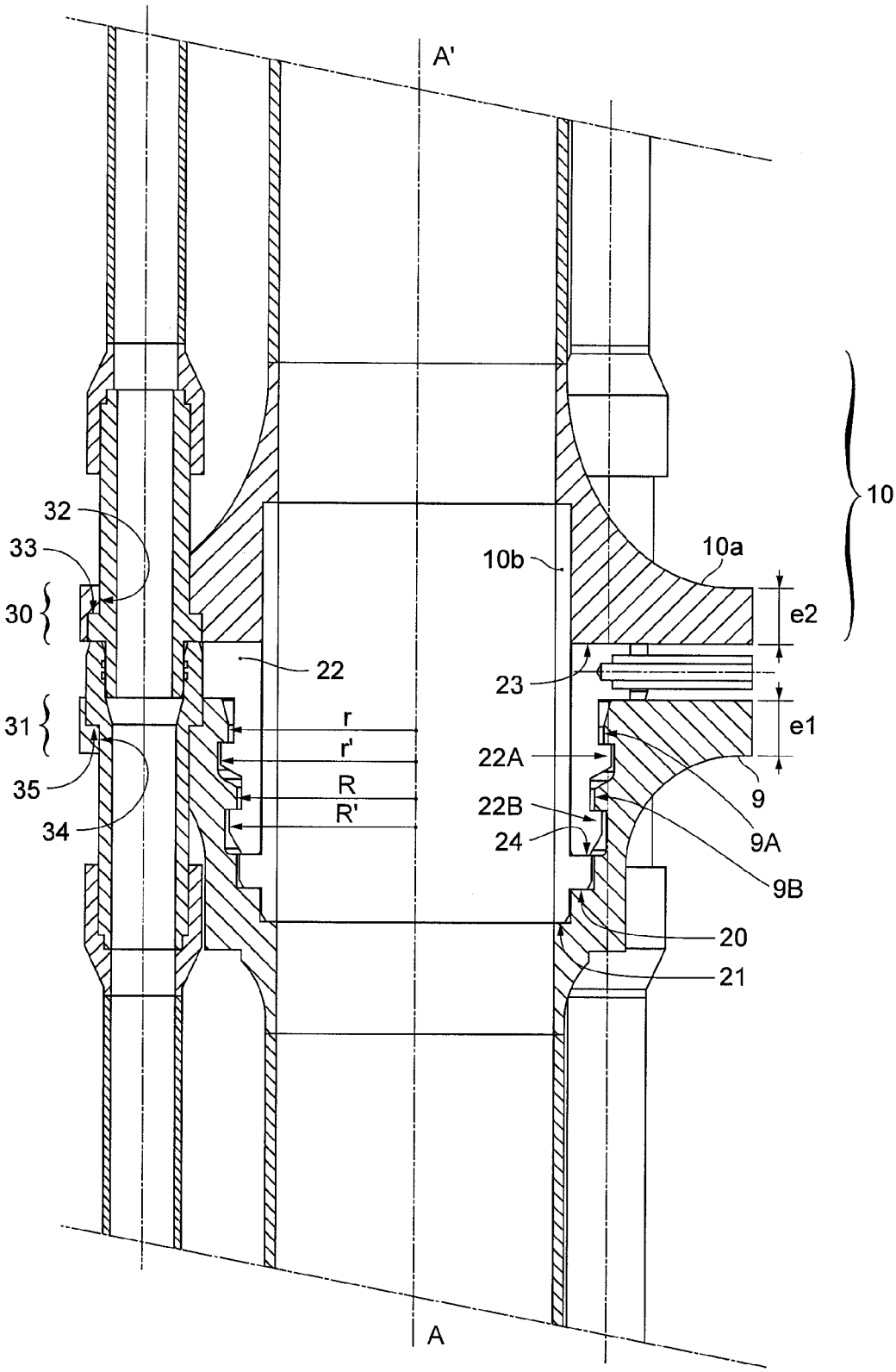
FIG. 3 shows a connector in locked position.

FIG. 3 shows a male tubular element 10 fitted in female tubular element 9. A portion of male tubular element 10 penetrates inside female tubular element 9. This fitting is limited by axial thrust 21*t* (the end of male element 10 abuts against axial shoulder 21*s* provided on the inner surface of female element 9) or by axial thrust 20*t* (axial shoulder 20*s* provided on the outer surface of male element 10 abuts against axial shoulder 20*s* provided on the inner surface of female element 9).

Connector 5 comprises a locking ring 22 positioned between element 9 and element 10. When element 10 fits into female element 9, part of ring 22 penetrates inside female element 9 so that the tenons of ring 22 cooperate with the tenons of female element 9. Locking and unlocking of connector 5 is achieved through rotation of ring 22 (bayonet type locking). Ring 22 is provided with an operating means, for example operating bar 8 that can be removable. Operating bar 8 allows rotation ring 22 in its housing provided in element 10, around axis AA'. The longitudinal stresses, that is those applied along axis AA', are transmitted from a section 4 to adjacent section 4 through the agency of the bayonet type connection between ring 22 and female element 9. More precisely, the longitudinal stresses are transmitted from the tenons of ring 22 to the tenons of female element 9.

The locking ring is mounted mobile in rotation on male element 10 while being locked in translation, in particular in the direction of axis AA'. With reference to FIG. 3, ring 22 is mounted on the outer surface of element 10. It is held in a housing defined and limited by axial shoulders 23 and 24 provided on element 10. In order to mount locking ring 22 on element 10, element 10 can be made of two parts 10*a* and 10*b*. Ring 22 is mounted on part 10*b* until it abuts against axial shoulder 24 provided on the outer surface of part 10*b*. Part 10*b* is then secured into part 10*a* so that the ring abuts against shoulder 23 of part 10*b*. For example, part 10*b* is screwed or welded in part 10*a*. Alternatively, parts 10*a* and 10*b* of element 10 can form a single piece. In this case, ring 22 consists of two parts that are assembled around part 10*a* of element 10.

Figure 4:
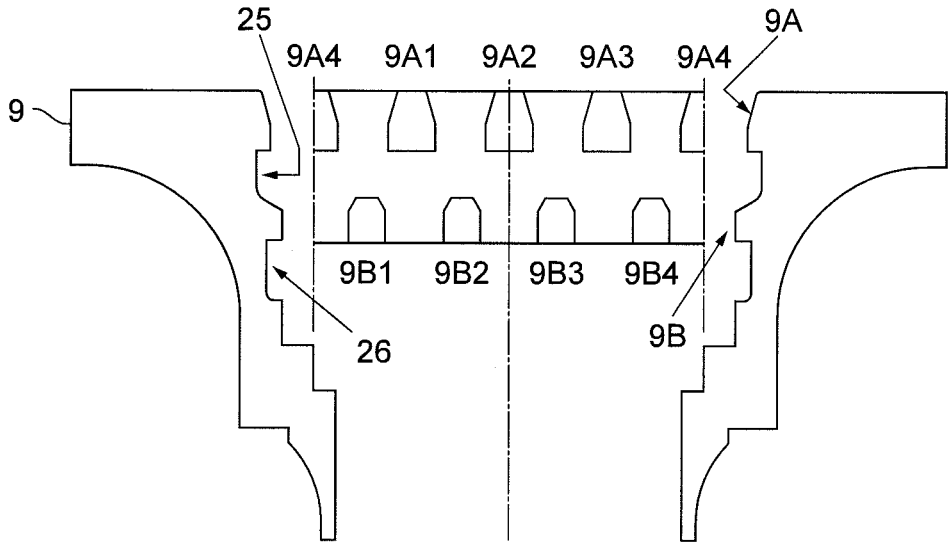
FIG. 4 shows the details of a connector locking ring according to the invention.
Figure 4:
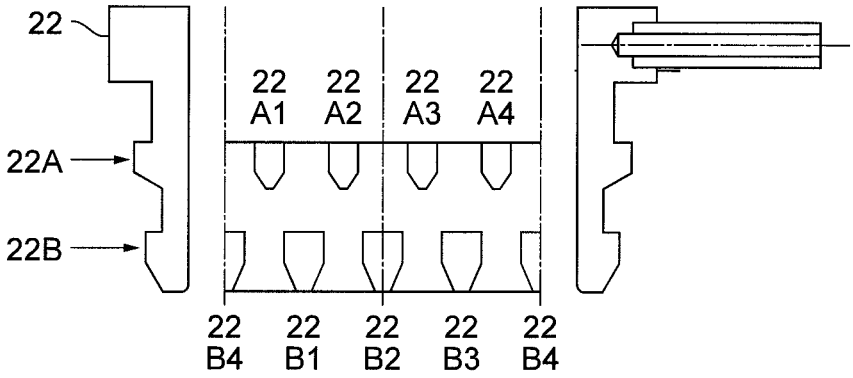

With reference to FIG. 3, female element 9 and ring 22 respectively comprise two crowns of tenons or studs 9A and 9B, and 22A and 22B, allowing to ensure axial locking of connector 5. The tenons preferably extend in radial directions. In FIG. 4, female element 9 comprises a first crown 9A of four tenons 9A1, 9A2, 9A3 and 9A4, and a second crown 9B of four tenons 9B1, 9B2, 9B3 and 9B4. Ring 22 also comprises a first crown 22A of four tenons 22A1, 22A2, 22A3 and 22A4, and a second crown 22B of four tenons 22B1, 22B2, 22B3 and 22B4.

The tenons exhibit an angular offset from one crown to the next and they are inscribed in cylindrical surfaces of different radii. With reference to FIG. 3, the first and the second crown of female element 9 are respectively inscribed in the cylindrical surfaces of radius r and R. The first and the second crown of ring 22 are respectively inscribed in the cylindrical surfaces of radius r' and R'. Radius r is slightly greater than radius R' so that tenons 22B1 to 22B4 of the second crown of ring 22 can slide and rotate freely within the cylinder formed by the inner surface of tenons 9A1 to 9A4 of first crown 9A of female element 9.

Tenons 22A1, 22A2, 22A3 and 22A4 of the first crown of ring 22 cooperate with tenons 9A1, 9A2, 9A3 and 9A4 of the first crown of female element 9 so as to form a bayonet assembly. Tenons 22B1, 22B2, 22B3 and 22B4 of the second crown of ring 22 cooperate with tenons 9B1, 9B2, 9B3 and 9B4 of the second crown of female element 9.

More precisely, when ring 22 fits into female element 9, ring 22 performs a translational motion in the direction of axis AA' according to the successive stages as follows:

- second crown 22B of the ring moves inside crown 9A of the female element, then
- tenons 22B fit between tenons 9B and, simultaneously, tenons 22A fit between tenons 9A, then
- when ring 22 abuts against element 9, tenons 22A1, 22A2, 22A3 and 22A4 lodge in slot 25 (diagrammatically shown in FIG. 4) provided in female element 9 between first crown 9A and second crown 9B, and tenons 22B1, 22B2, 22B3 and 22B4 lodge in slot 26 (diagrammatically shown in FIG. 4) provided in female element 9 below second crown 9B.

Then, when ring 22 abuts against female element 9, ring 22 is pivoted so that the tenons of the ring are positioned opposite the tenons of the female element. The tenons of crown 22A are positioned opposite the tenons of crown 9A and the tenons of crown 22B are positioned opposite the tenons of crown 9B. Thus, the tenons of ring 22 are axially abutted with respect to the tenons of female element 9 and they lock in translation element 9 with respect to element 10.

Each one of the two bayonet assembly systems allow providing, between the tenons of female element 9 and the tenons of ring 22, contact over a total angular range that can reach 175°. Preferably, the two assembly systems are angularly offset around the connector axis so that the connector according to the invention allows the axial loads to be distributed over about 350° around the axis.

Alternatively, according to the invention, ring 22 and element 9 may comprise only one crown each: the tenons of the single crown of ring 22 cooperate with the tenons of the single crown of element 9.

The number of tenons per crown can vary, notably depending on the diameters of the inner tube and on the stresses to be transmitted by the connector.

A locking system allows ring 22 to be locked in rotation.

According to the invention, auxiliary line element 7 is secured, at each end thereof, to main tube 6. In other words, riser section 1 comprises at each end thereof fastening means 30 and 31, diagrammatically shown in FIG. 3, allowing an auxiliary line element 7 to be axially linked to main tube 6. According to the invention, means 30 and 31 allow longitudinal stresses to be transmitted from main tube 6 to elements 7. Thus, these fastening means 30 and 31 allow the tensional stresses undergone by each section of the riser pipe to be distributed among main tube 6 and auxiliary line elements 7.

At the level of the section end provided with female connector means 9, main tube 6 has as an extension shoulder or flange 13 comprising a cylindrical passage wherein auxiliary line element 7 can slide. Auxiliary element 7 comprises a thrust 35, a nut or a shoulder for example, intended to position element 7 axially with respect to flange 13. When mounting element 7 on main tube 6, thrust 35 of element 7 rests against flange 13, for example against the axial shoulder provided in passage 34 so as to form a rigid link.

At the level of the section end provided with male connector means 10, main tube 6 has as an extension shoulder or flange 14 comprising a cylindrical passage 32 wherein auxiliary line element 7 can slide. Auxiliary element 7 comprises a thrust 33, a nut or a shoulder for example, intended to position element 7 axially with respect to flange 14. When mounting element 7 on main tube 6, the thrust of element 7 rests against flange 14, for example against the axial shoulder provided in passage 32 so as to form a rigid link.

The female 9 and male 10 connector elements have shapes of revolution around axis AA'. According to the invention, elements 9 and 10 form an extension of main tube element 6 while increasing the thickness and the outer section of the tube, so as to form shoulders 13 and 14 respectively. Preferably, the outer section of elements 9 and 10 varies progressively along axis 8 so as to avoid a sudden section variation between tube 6 and shoulders 13 and 14 that would weaken the mechanical strength of connector 5. For example, with reference to FIG. 2, elements 13 and 14 form fillets of radius R1 and R2.

Fastening means 30 allow locking of the axial translations of an element 7 in one direction, fastening means 31 allowing locking the axial translations of an element 7 in the opposite direction. The combination of fastening means 30 and of fastening means 31 allows element 7 to be completely secured with respect to main tube element 6. Thus, elements 7 are involved, together with main tube element 6, in the taking up of the longitudinal stresses undergone by pipe 1.

The shape and in particular the thickness e1 and e2 of flanges 13 and 14 are determined so as to withstand the longitudinal stresses transmitted to auxiliary line elements 7.

Auxiliary line elements 7 are connected end to end by means of connections. A connection is made up of a male end 40 arranged at one end of element 7 and of a female end 41 arranged at the other end of element 7. A male end 40 cooperates tightly with female end 41 of another element 7. For example, male element 40 of the connection is a tubular part that fits into another tubular part 41. The inner surface of female end 41 is adjusted to the outer surface of male end 40. Joints are mounted in slots machined on the inner surface of female element 41 so as to provide a tight link. The connection allows axial displacement of one of elements 7 with respect to the other, while maintaining the tight link between the two elements.

Auxiliary line element 7 can consist of the assembly of several parts. Element 7 is made up of tube 7*a* of substantially same length as element 6. Wearing parts 7*b* and 7*c* form an extension of tube 7*a* at the end thereof. For example, parts 7*b* and 7*c* are screwed onto tube 7*a*. Part 7*b* comprises fastening elements 30 and end part 40. Part 7*c* comprises fastening elements 31 and end part 41. Parts 7*b* and 7*c* can be changed independently of tube 7*a*, for example in case of wear. Furthermore, parts 7*b* and 7*c* allow facilitating mounting of elements 7 on element 6. Parts 7*b* and 7*c* can be respectively fed into orifice 32 provided in flange 14 and orifice 33 provided in flange 13. Tube 7*a* is then screwed onto parts 7*b* and 7*c* until parts 7*b* and 7*c* respectively abut against flanges 14 and 13.

Arranging ring 22 between male element 10 and female element 9 allows a more compact layout of connector 5. The position of ring 22 allows reduction of the space occupied by the connector in the radial direction. It is consequently possible to limit the spacing between elements 7 arranged on the periphery of connector 5 and axis AA'. The reduced spacing between element 7 and axis AA' consequently allows minimizing the bending stresses undergone by flanges 13 and 14. In fact, flanges 13 and 14 transmit and thus endure the longitudinal stresses that are taken up by elements 7. The spacing between elements 7 and axis AA' constitutes a lever arm that, combined with the longitudinal stresses taken up by elements 7, induces bending stresses in flanges 13 and 14. The compact connector according to the invention allows minimizing the bending stresses in the flanges, therefore to reduce the dimensions of flanges 13 and 14 and to reduce the weight of the connectors.

Furthermore, the device according to the invention provides an interesting solution for mounting in a simple and fast way a riser pipe whose tensile stresses are distributed among the auxiliary tube elements and the main tube. In fact, although auxiliary tube elements 7 and main tube element 6 are mounted so as to jointly endure the tensile stresses undergone by the pipe, connecting a riser pipe section 4 to another riser pipe section 4 is achieved in a single operation by means of ring 22. This connection allows communication and sealing the main tube element of a section with respect to the element of the other section, and to simultaneously communicate and seal the auxiliary line elements 7 of one of the sections with respect to those of the other section.

Besides, the fact that ring 22 is positioned between element 9 and element 10 allows increasing the strength of the connector. In fact, ring 22 is mechanically held on the inner side by the housing provided in element 10. Furthermore, in the locked position, the tenons of ring 22 are in mesh with the tenons of element 9 that are positioned on the massive part of element 9.

Figure 5:
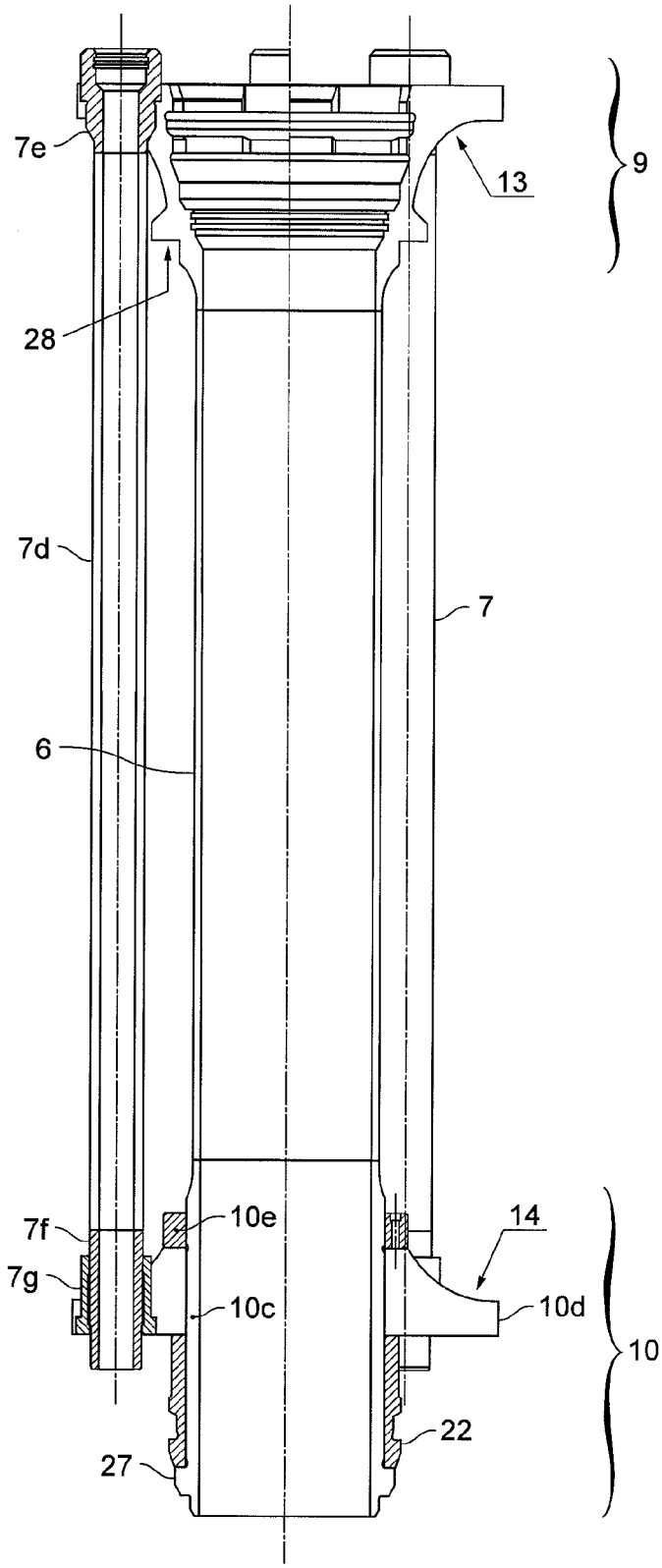
FIG. 5 shows another embodiment of a riser pipe section according to the invention.

FIG. 5 provides various options for the embodiment of the invention.

The reference numbers of FIG. 5 identical to those of FIG. 2 designate the same elements.

With reference to FIG. 5, male connector element 10 is made of three parts. Part 10*c* has the shape of a tube section forming an extension of main tube element 6. The outside diameter of tube section 10*c* is substantially equal to the inside diameter of ring 22 so as to be able to mount ring 22 on part 10*c*. Part 10*c* is secured to tube element 6, by welding for example. The end of part 10*c* comprises a shoulder 27 acting as a thrust for ring 22. Shoulder 14 consists of second part 10*d* of annular shape. The inside diameter of part 10*d* corresponds to the outside diameter of tube section 10*c* so as to be able to mount part 10*d* on part 10*c*. The ring abuts against part 10*d* and shoulder 27 of the outer surface of part 10*c*. Part 10*e* is a collar that holds part 10*d* and ring 22 against shoulder 27. For example, a screw fits into threads provided on the outer surface of section 10*c*.

With reference to FIG. 5, female connector element 9 comprises a bearing surface 28 perpendicular to axis AA' of section 4 and oriented towards male connector element 10. This bearing surface allows holding the riser pipe portion suspended from the rotary table while it is being assembled.

With reference to FIG. 5, auxiliary line element 7 is an assembly of several parts. Element 7 is made up of tube 7*d* that has substantially the same length as element 6. Parts 7*e* and 7*f* form extensions of tube 7*d* at the ends thereof. Parts 7*e* and 7*f* are welded to tube 7*d*. Part 7*e* comprises a shoulder that abuts against shoulder 13 of female connector element 9. Part 7*g* that is screwed onto end part 7*f* serves as a thrust for element 7 against shoulder 14.

The following operations can be carried out to achieve connection of the connector according to the invention.

Operation 1

Ring 22 is held in open position by a locking system.

Male element 10 of a section faces female element 9 of another section. For example, female element 9 is suspended from a handling table and element 10 is operated by hoisting means.

The position of auxiliary line elements 7 allows element 10 to be angularly positioned with respect to element 9.

Operation 2

Male element 10 is slid longitudinally in female element 9 until the two elements fit into and abut against one another.

When element 10 fits into element 9, on the one hand, the tenons of ring 22 slide between the tenons of element 9 as described above and, on the other hand, male end parts 40 of elements 7 penetrate inside female end parts 41 of elements 7.

Operation 3

When element 10 is fitted inside element 5, ring 22 is released in rotation by acting upon the locking system, then ring 22 is pivoted around the connector axis. Rotation of ring 22 is performed until a closed position is reached, i.e. until the tenons of ring 22 are positioned opposite the tenons of female element 9. The locking system can limit rotation of the ring.

When ring 22 is in closed position, the ring is immobilized with respect to element 9 by acting upon the locking system.

The invention claimed is:

1. A riser pipe section for offshore well drilling operations, comprising a main tube element including an extension with a male connector element and a female connector element comprising:

first tenons, at least one auxiliary tube element secured to the male connector element and to the female connector element so that the main tube and the at least one auxiliary tube element jointly transmit tensile stresses between the male connector element and the female connector element, and wherein a locking ring is mounted on the male connector element such that the locking ring will be positioned between a female connector element of an adjacent riser pipe section and the male connector element, with the locking ring comprising second tenons interacting with first tenons of the female connector element of the adjacent riser pipe section for locking the female connector element of the adjacent riser pipe section and the male connector element together, wherein the first tenons are positioned on an inner surface of the female connector element and the second tenons are positioned on an outer surface of the locking ring.

2. A riser pipe section as claimed in claim 1, wherein the locking ring is housed in a slot disposed on an outer surface of the male connector element.

3. A riser pipe section as claimed in claim 2, wherein the male connector element comprises a tubular part forming an extension of the main tube element and an annular part mounted on the tubular part, with the locking ring being mounted on the tubular part and locked in translation between the tubular part and annular part.

4. A riser pipe section as claimed in claim 3, wherein the male connector element includes a first shoulder extending outwardly relative to the main tube element and the female connector element includes a second shoulder extending outwardly relative to the main tube element and the at least one auxiliary tube element is mounted axially abutted against the first shoulder and against the second shoulder.

5. A riser pipe section as claimed in claim 4, wherein the male connector element is an extension of the main tube element and progressively increases in thickness relative to a thickness of the main tube element up to the first shoulder and the female connector element is an extension of main tube element and progressively increases in thickness relative to a thickness of the main tube element up to the second shoulder.

6. A riser pipe section as claimed in claim 2, wherein the male connector element comprises a first part including an extension of the main tube element and a second tubular part mounted on the first part, the locking ring being mounted on the second tubular part and locked in translation between the first part and the second tubular part.

7. A riser pipe section as claimed in claim 6, wherein the male connector element includes a first shoulder extending outwardly relative to the main tube element and the female connector element includes a second shoulder extending outwardly relative to the main tube element and the at least one auxiliary tube element is mounted axially abutted against the first shoulder and against the second shoulder.

8. A riser pipe section as claimed in claim 7, wherein the male connector element is an extension of the main tube element and progressively increases in thickness relative to a thickness of the main tube element up to the first shoulder and the female connector element is an extension of main tube element and progressively increases in thickness relative to a thickness of the main tube element up to the second shoulder.

9. A riser pipe section as claimed in claim 2, wherein the male connector element includes a first shoulder extending outwardly relative to the main tube element and the female connector element includes a second shoulder extending outwardly relative to the main tube element and the at least one auxiliary tube element is mounted axially abutted against the first shoulder and against the second shoulder.

10. A riser pipe section as claimed in claim 9, wherein the male connector element is an extension of the main tube element and progressively increases in thickness relative to a thickness of the main tube element up to the first shoulder and the female connector element is an extension of main tube element and progressively increases in thickness relative to a thickness of the main tube element up to the second shoulder.

11. A riser pipe section as claimed in claim 1, wherein the male connector element includes a first shoulder extending outwardly relative to the main tube element and the female connector element includes a second shoulder extending outwardly relative to the main tube element and the at least one auxiliary tube element is mounted axially abutted against the first shoulder and against the second shoulder.

12. A riser pipe section as claimed in claim 11, wherein the male connector element is an extension of the main tube element and progressively increases in thickness relative to a thickness of the main tube element up to the first shoulder and the female connector element is an extension of main tube element and progressively increases in thickness relative to a thickness of the main tube element up to the second shoulder.

13. A riser pipe section as claimed in claim 1, comprising a part which forms an extension of one end of the at least one auxiliary tube element, wherein the part is configured to receive wear.

14. A riser pipe section as claimed in claim 1, wherein the ring comprises means for rotating the locking ring.

15. A riser pipe section as claimed in claim 1, comprising a means for locking the locking ring.

16. A riser pipe comprising a plurality of riser pipe sections comprising a main tube element including an extension with a male connector element and a female connector element including first tenons, at least one auxiliary tube element secured to the male connector element and to the female connector element so that the main tube and the at least one auxiliary tube element jointly transmit tensile stresses between the male connector element and the female connector element, and wherein a locking ring is mounted on the male connector element, with the locking ring comprising second tenons for locking the female and male connector elements together and wherein the longitudinal tensile stresses are distributed among the main tube element and the at least one auxiliary tube element of each riser pipe section, wherein the locking ring is configured to be positioned between the female and the male connector elements, and the first tenons are positioned on an inner surface of the female connector element and the second tenons are positioned on an outer surface of the locking ring.

17. A riser pipe as claimed in claim 16, wherein the locking ring is positioned between the female and the male connector elements.

18. A riser pipe comprising:

a plurality of riser pipe sections, at least two riser pipe sections of the plurality of riser pipe sections each comprising a main tube element and at least one auxiliary tube element, a first end of the main tube element comprising a male connector element and a second end of the main tube element comprising a female connector element, the at least one auxiliary tube element being secured to the male connector element and to the female connector element so that the main tube element and the at least one auxiliary tube element jointly transmit tensile stresses between the male connector element and the female connector element, wherein an inner surface of the female connector element comprises first tenons; and a locking ring mounted on the male connector element, an outer surface of the locking ring comprising second tenons, the second tenons being configured to lock with the first tenons of the female connector element of an adjacent riser pipe section, the locking ring being configured to be positioned between the male connector element and the female connector element of the adjacent riser pipe section.

* * * * *